US009027700B2

(12) United States Patent
Kim et al.

(10) Patent No.: US 9,027,700 B2
(45) Date of Patent: May 12, 2015

(54) BONDING STRUCTURE OF DIAPHRAGM FOR MICROSPEAKER

(71) Applicant: Em-Tech. Co., Ltd., Busan (KR)

(72) Inventors: Ji Hoon Kim, Gyeongsangnam-do (KR); Joong Hak Kwon, Busan (KR); Jung Hyung Lee, Gyeongsangnam-do (KR); Hyeon Taek Oh, Gyeongsangnam-do (KR)

(73) Assignee: Em-Tech. Co., Ltd., Busan (KR)

( * ) Notice: Subject to any disclaimer, the term of this patent is extended or adjusted under 35 U.S.C. 154(b) by 0 days.

(21) Appl. No.: 14/031,385

(22) Filed: Sep. 19, 2013

(65) Prior Publication Data

US 2014/0318885 A1 Oct. 30, 2014

(30) Foreign Application Priority Data

Apr. 25, 2013 (KR) ..... 10-2013-0046102

(51) Int. Cl.

| | |
|---|---|
| ***H04R 7/02*** | (2006.01) |
| ***H04R 7/14*** | (2006.01) |
| ***H04R 9/04*** | (2006.01) |
| ***H04R 31/00*** | (2006.01) |

(52) U.S. Cl.

CPC .. *H04R 7/02* (2013.01); *H04R 7/14* (2013.01); *H04R 9/043* (2013.01); *H04R 31/003* (2013.01)

(58) Field of Classification Search

CPC ..... H04R 7/02; H04R 31/003; H04R 9/043; H04R 7/14

See application file for complete search history.

(56) References Cited

U.S. PATENT DOCUMENTS

| | | | |
|---|---|---|---|
| 2007/0047757 | A1 | 3/2007 | Yang et al. |
| 2011/0026757 | A1 | 2/2011 | Takahashi et al. |

FOREIGN PATENT DOCUMENTS

| | | | |
|---|---|---|---|
| EP | 2 490 461 | | 8/2012 |
| JP | 58-71799 | | 4/1983 |
| JP | 2006311317 | A * | 11/2006 |

OTHER PUBLICATIONS

Extended European Search Report for European Application 13004359.9 (Nov. 8, 2013).

* cited by examiner

*Primary Examiner* — Jeremy Luks

(74) *Attorney, Agent, or Firm* — Murphy, Bilak & Homiller, PLLC

(57) ABSTRACT

The present invention relates to an assembly structure of a diaphragm for a microspeaker. The present invention discloses a bonding structure of a diaphragm for a microspeaker, the boding structure comprising: a suspension including a central portion, an outer peripheral portion, and a connecting portion connecting the central portion and the outer peripheral portion; and a side diaphragm including an inner peripheral portion and an outer peripheral portion, which are attached to the central portion and outer peripheral portion of the suspension, respectively, and a dome portion, which projects between the inner peripheral portion and the outer peripheral portion, wherein the suspension and the side diaphragm are attached by thermal compression.

10 Claims, 8 Drawing Sheets

BONDING STRUCTURE OF DIAPHRAGM FOR MICROSPEAKER

TECHNICAL FIELD

The present invention relates to an attachment structure of a diaphragm for a microspeaker.

BACKGROUND ART

FIG. 1 is a view showing an example of a conventional microspeaker.

A yoke 21, an inner ring magnet 22, an outer ring magnet 23, an inner ring top plate 24, and an outer ring top plate 25 are installed within a frame 10, and a voice coil 30 is placed in air gaps between the inner ring magnet 22 and the outer ring magnet 23 and vibrates vertically when power is applied to the voice coil 30. The voice coil 30 is mounted to the bottom side of a suspension 40, and a side diaphragm 51 and a center diaphragm 52 are installed on the top and bottom sides of the suspension 40 and vibrate in synchrony with the vibration of the voice coil 30, producing a sound. A protector 60 is connected to the top of suspension 40 to protect the parts located inside a speaker. The protector 60 includes a ring-shaped steel portion 61 with an opening in the middle to emit a sound, and a ring-shaped injection portion 62, through which the steel portion 61 is inserted and injection-molded and which is laminated on top of the frame 10, the outer periphery of the side diaphragm 51, and the outer periphery of the suspension 40.

Conventionally, a bond or double-sided tape has been used to attach the side diaphragm 51 and the center diaphragm 52 to the suspension 40. However, there is a drawback that, though the bond has high bonding property, it causes a large deviation in application thickness and a deviation in laminate thickness of a sound transducer, thereby causing non-uniformity in the quality of finished products. In addition, the double-sided tape causes little deviation in thickness but has low adhesion.

DISCLOSURE OF THE INVENTION

An object of the present invention is to provide a bonding structure of a diaphragm and a suspension in a microspeaker, which minimizes thickness deviations and provides high adhesion.

According to an aspect of the present invention for achieving the above objects, there is provided a bonding structure of a diaphragm for a microspeaker, the bonding structure comprising: a suspension including a central portion, an outer peripheral portion, and a connecting portion connecting the central portion and the outer peripheral portion; and a side diaphragm including an inner peripheral portion and an outer peripheral portion, which are attached to the central portion and outer peripheral portion of the suspension, respectively, and a dome portion, which projects between the inner peripheral portion and the outer peripheral portion, wherein the suspension and the side diaphragm are attached by thermal compression.

In addition, the suspension consists of an FPCB.

Moreover, the suspension includes a base film, a conductive pattern attached to both sides of the base film, and a cover layer attached on the conductive pattern, and the cover layer attached to the side diaphragm is made of either a PEEK film or a PEI-F film.

Additionally, the side diaphragm is formed by joining two or more sheets of film together.

Furthermore, the bonding surface of the side diaphragm is made of a TPU film, and the other surface of the side diaphragm is made of a PEEK film.

Still furthermore, the bonding surface of the side diaphragm is made of a TPU film, and the bonding surface of the suspension is made of either a PEEK film or a PEI-F film.

Still furthermore, the bonding structure further comprises a bonding sheet interposed between the side diaphragm and the suspension, wherein the suspension and the side diaphragm are attached by being thermally compressed to the bonding sheet.

Still furthermore, the bonding structure further comprises a center diaphragm attached to the central portion of the suspension, wherein the center diaphragm and the suspension are attached by thermal compression.

Still furthermore, the bonding structure further comprises a center diaphragm attached to the side diaphragm, wherein the side diaphragm and the center diaphragm are attached by thermal compression.

Still furthermore, the voice coil is attached to the bottom side of the center diaphragm, spaced apart from the side diaphragm and the suspension.

According to another aspect of the present invention, there is provided a bonding structure of a diaphragm for a microspeaker, the bonding structure comprising: a side diaphragm perforated in the center and including an inner peripheral portion, an outer peripheral portion, and a dome portion projecting between the inner peripheral portion and the outer peripheral portion; and a center diaphragm attached to the inner peripheral portion of the side diaphragm, wherein the side diaphragm and the center diaphragm are attached by thermal compression.

In addition, the side diaphragm is attached to the top or bottom side of the center diaphragm.

Moreover, the voice coil is attached to the bottom side of the center diaphragm.

Additionally, the dome portion of the side diaphragm is in the shape of a reverse dome, which projects downward, or a forward dome, which projects upward.

The bonding structure of the diaphragm for the microspeaker provided by the present invention can enhance adhesion because it minimizes deviations in thickness by attaching a diaphragm by thermal compression.

BEST MODE FOR CARRYING OUT THE INVENTION

Hereinafter, the present invention will be described in more detail with reference to the drawings.

Figure 1:
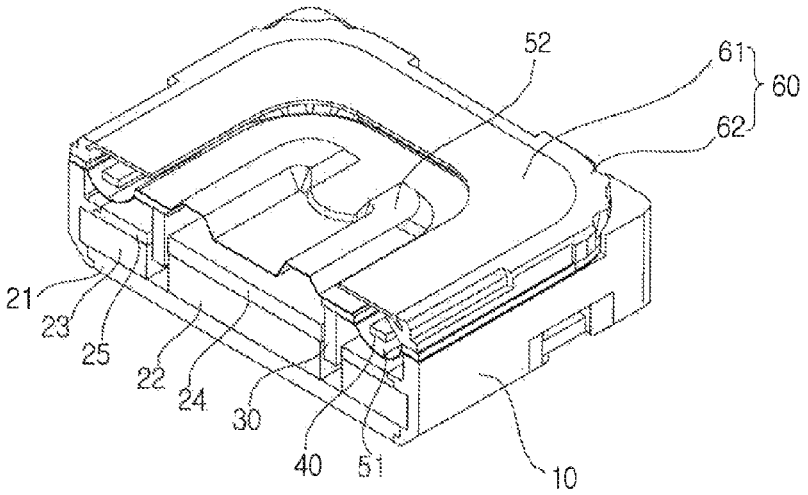
FIG. 1 (PRIOR ART)
FIG. 1 is a view showing an example of a conventional microspeaker.
Figure 2:
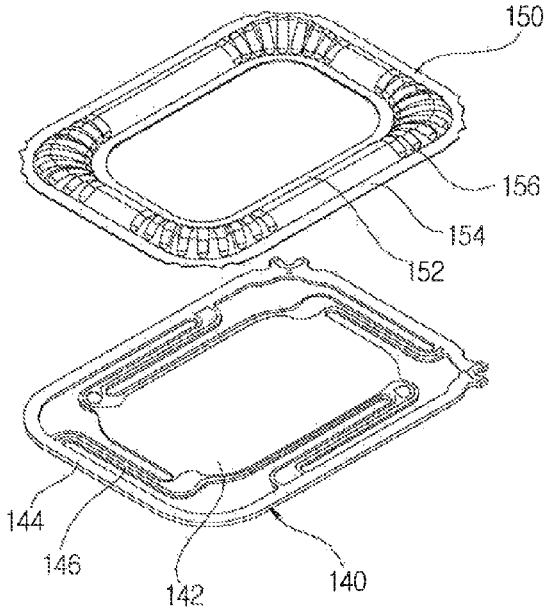
FIGS. 2 and 3 are views showing a process of bonding a diaphragm for a microspeaker according to a first embodiment of the present invention.
Figure 3:
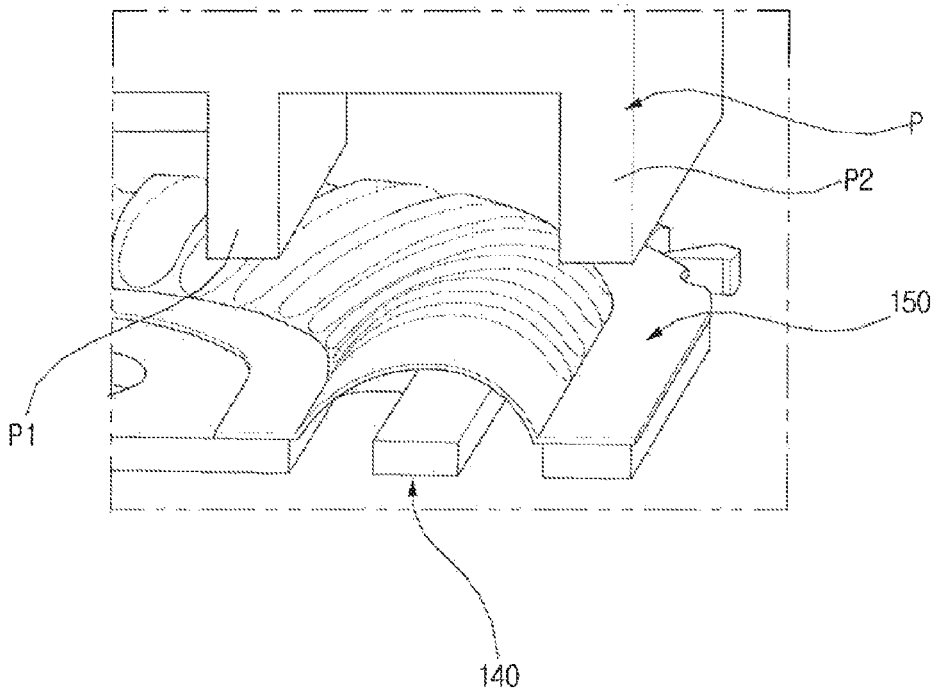

FIGS. 2 and 3 are views showing a process of bonding a diaphragm for a microspeaker according to a first embodiment of the present invention. The bonding structure of the diaphragm for the microspeaker according to the first embodiment of the present invention is a structure that bonds a suspension 140 and a side diaphragm 150. The suspension 1 consists of an FPCB and includes a central portion 142, an outer peripheral portion 144, and a connecting portion 146 connecting the central portion 142 and the outer peripheral portion 144. The side diaphragm 150 is in the shape of a ring, the center of which is entirely perforated, and includes an inner peripheral portion 152 attached to the central portion 146 of the suspension 140, an outer peripheral portion 154 attached to the outer peripheral portion 144 of the suspension 140, and a dome portion 156 projecting between the inner peripheral portion 152 and the outer peripheral portion 154. Using a thermal compression method, the central portion 142 of the suspension 140 and the inner peripheral portion 152 of the side diaphragm 150 are attached together, and the outer peripheral portion 144 of the suspension 140 and the outer peripheral portion 154 of the side diaphragm 150 are attached together.

They are thermally compressed by applying pressure to them by a thermocompression press P. The thermocompression press P includes a first compression part P1 that thermally compresses the central portion 142 of the suspension 140 and the inner peripheral portion 152 of the side diaphragm 150, and a second compression part P2 that thermally compresses the outer peripheral portion 144 of the suspension 140 and the outer peripheral portion 154 of the side diaphragm 150.

Figure 4:
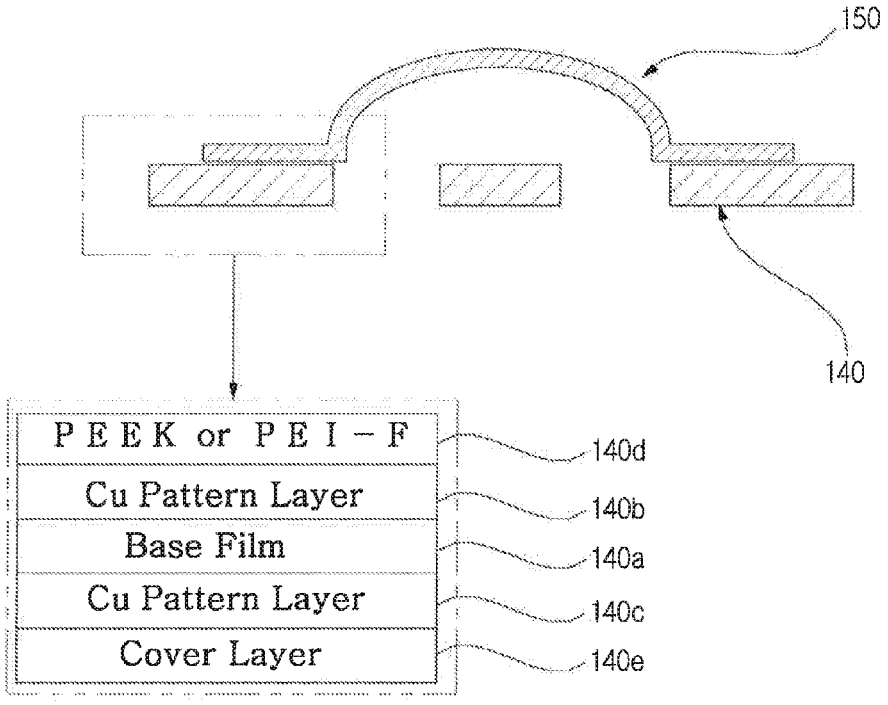
FIG. 4 is a schematic sectional view showing the bonding structure of the diaphragm for the microspeaker according to the first embodiment of the present invention.

FIG. 4 is a schematic sectional view showing the bonding structure of the diaphragm for the microspeaker according to the first embodiment of the present invention. The suspension 140 includes a base film 140*a*, a conductive pattern layer 140*b* and 140*c* formed on both sides of the base film, and a cover layer 140*d* and 140*e* attached to the top of the conductive pattern layer. The side diaphragm 150 is preferably made of a TPU film with low rigidity so as to improve the low-frequency characteristics. In this case, it is preferred that the cover layer 140*d* on one of the two sides of the suspension 140, where the side diaphragm 150 is attached, is made of either a PEEK film or a PEI-F film, which shows excellent binding strength after it is thermally compressed to the TPU film.

Figure 5:
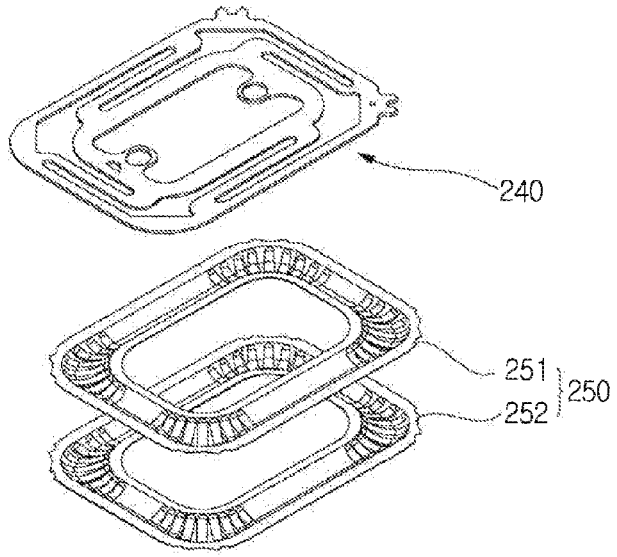
FIG. 5 is a view showing a bonding structure of a diaphragm for a microspeaker according to a second embodiment of the present invention.

FIG. 5 is a view showing a bonding structure of a diaphragm for a microspeaker according to a second embodiment of the present invention. In the bonding structure of the diaphragm for the microspeaker according to the second embodiment of the present invention, a side diaphragm 250 is formed by joining two sheets of film together. A first film 251 attached to a suspension 240 is made of a material that is easily thermocompressed to the suspension 240, and a second film 252 attached to the first film 251 is made of a material that is easily thermocompressed to the first film 251. Either the first film 251 or the second film 252 is preferably made of a material with low rigidity so as to improve the low-frequency characteristics.

In one example, it is preferred that the first film 251 is made of a TPU film with low rigidity, and the second film 252 is made of a PEEK film or PEI-F film, which shows excellent binding strength after it is thermally compressed to the TPU film. If the first film 251 is made of a TPU film, the suspension 240 is also preferably made of a PEEK film or PEI-F film for excellent binding strength.

Figure 6:
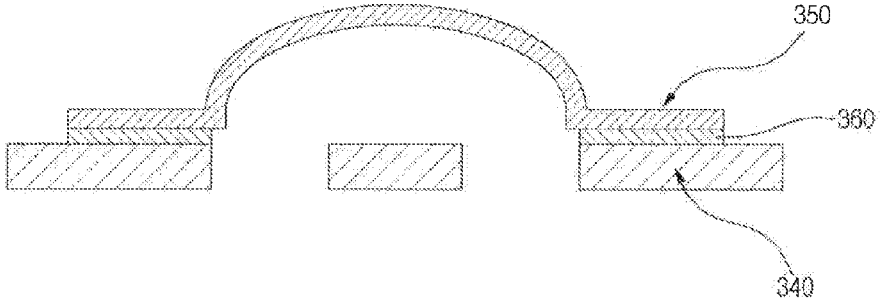
FIG. 6 is a view showing a bonding structure of a diaphragm for a microspeaker according to a third embodiment of the present invention

FIG. 6 is a view showing a bonding structure of a diaphragm for a microspeaker according to a third embodiment of the present invention. In the bonding structure of the diaphragm for the microspeaker according to the third embodiment of the present invention, a bonding sheet 360 is additionally interposed between the bonding surfaces of a suspension 340 and a side diaphragm 350. Afterwards, the suspension 340 and the side diaphragm 350 are bonded together through the bonding sheet 360 by thermocompression using the thermocompression press P (see FIG. 2) of the first embodiment. Interposing the bonding sheet 360 for thermal compression has an advantage of offering a wider selection of materials of the suspension 340 and the diaphragm 350.

Figure 7:
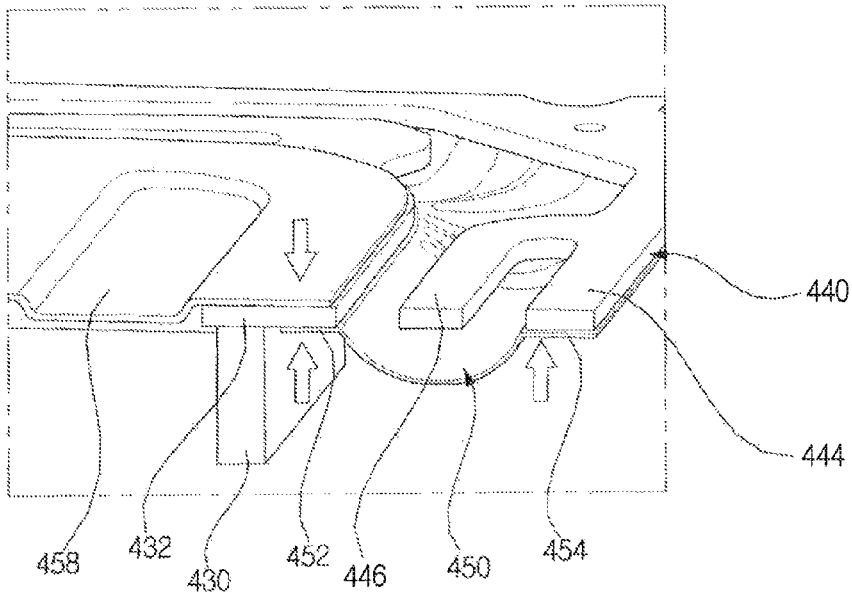
FIG. 7 is a view showing a bonding structure of a diaphragm for a microspeaker according to a fourth embodiment of the present invention.

FIG. 7 is a view showing a bonding structure of a diaphragm for a microspeaker according to a fourth embodiment of the present invention. In the bonding structure of the diaphragm for the microspeaker according to the fourth embodiment of the present invention, both a side diaphragm 450 and a center diaphragm 458 are attached to a suspension 440. Like the first embodiment, the suspension 440 includes a central portion 442, an outer peripheral portion 444, and a connecting portion 446. An inner peripheral portion 452 of the side diaphragm 450 is thermally compressed to the central portion 442 of the suspension 440, and an outer peripheral portion 454 of the side diaphragm 450 is thermally compressed to the outer peripheral portion 444 of the suspension 440. Here, the side diaphragm 450 is attached to the bottom side of the suspension 440.

The center diaphragm 458 is attached to the central 442 of the suspension 440 and thermally compressed like the side diaphragm 450 is. In this case, the center diaphragm 458 is attached to the top side of the suspension 440.

A voice coil 430 is attached to the bottom side of the suspension 440, spaced a predetermined distance apart from the attachment position of the side diaphragm 450.

In the fourth embodiment, the bonding surfaces of the side diaphragm 450 and center diaphragm 458 may be reversed: the center diaphragm 458 may be attached to the bottom side of the suspension 440, and the side diaphragm 450 may be attached to the top side of the suspension 440.

Figure 8:
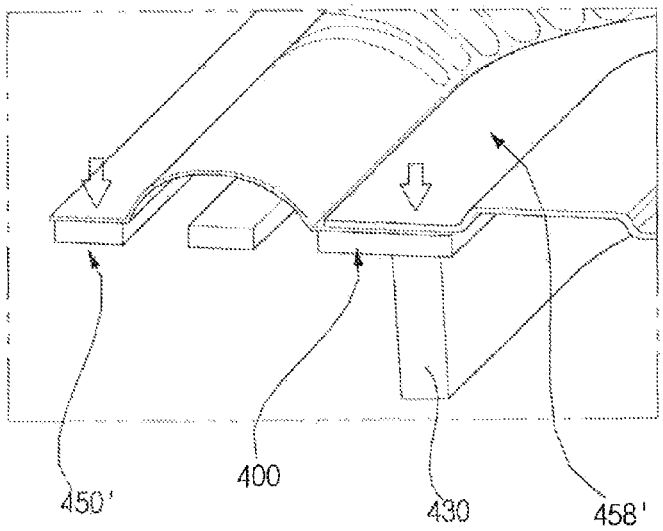
FIG. 8 is a view showing a bonding structure of a diaphragm for a microspeaker according to a fifth embodiment of the present invention.

FIG. 8 is a view showing a bonding structure of a diaphragm for a microspeaker according to a fifth embodiment of the present invention. The shapes of the parts of the fifth embodiment are identical to those of the fourth embodiment of the present invention, except for the attachment positions of a side diaphragm 450' and a center diaphragm 458'. In the bonding structure of the diaphragm for the microspeaker according to the fifth embodiment of the present invention, the side diaphragm 450' is first laminated on the top side of the suspension 440, and the center diaphragm 458' is then laminated on top of the side diaphragm 450', followed by thermal compression. Accordingly, the side diaphragm 450' and the suspension 440 are thermally compressed together, and the side diaphragm 450' and the center diaphragm 458' are thermally compressed together.

Of course, the lamination order may be changed in such a manner that the center diaphragm 458' is first laminated on the suspension 440, and the side diaphragm 450' is then laminated on top of the center diaphragm 458', followed by thermal compression.

Three layers of the suspension 440, the side diaphragm 450' and the center diaphragm 458' are thermally compressed together, and a voice coil 430 is then attached to the bottom side of the suspension 440.

Figure 9:
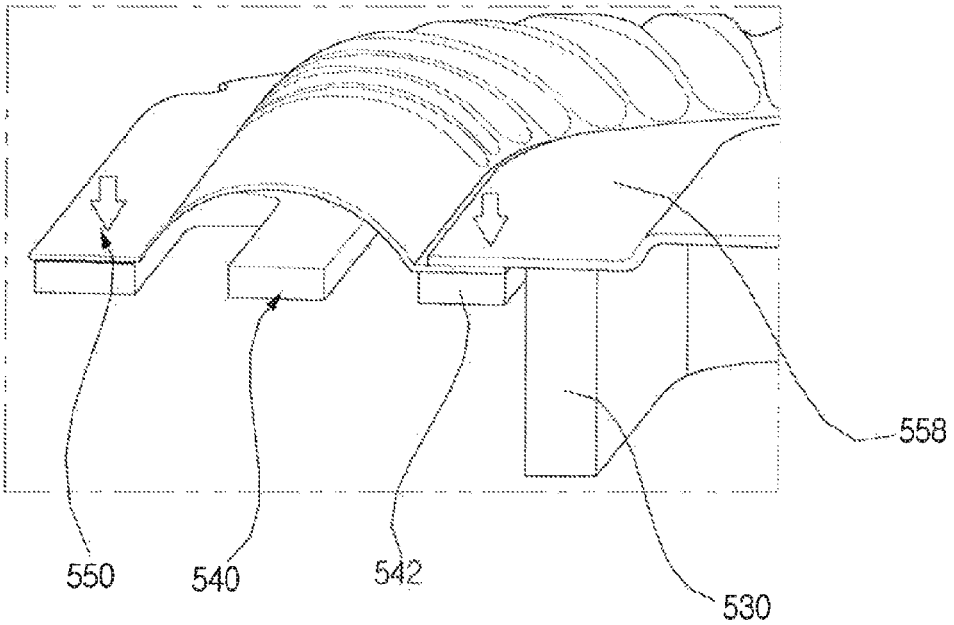
FIG. 9 is a view showing a bonding structure of a diaphragm for a microspeaker according to a sixth embodiment of the present invention.

FIG. 9 is a view showing a bonding structure of a diaphragm for a microspeaker according to a sixth embodiment of the present invention. The thermal compression method of the sixth embodiment of the present invention is identical to that of the fifth embodiment of the present invention, except for the attachment position of a voice coil 530. As a side diaphragm 550 and a center diaphragm 558 are laminated on the top side of a suspension 540, three layers are thermally compressed together. However, the voice coil 530 is attached not on the bottom side of the suspension 540 but on the bottom side of the center diaphragm 558. The voice coil 530 is attached to the bottom side of the center diaphragm 558, spaced a predetermined distance apart from the side diaphragm 550 and an inner periphery 542 of the suspension 540.

Unlike the example shown in FIG. 9, the center diaphragm 558 may be first laminated on the top side of the suspension 540, the side diaphragm 550 may be then laminated on top of the center diaphragm 558, followed by thermal compression, and thereafter the voice coil 530 may be attached to the bottom side of the center diaphragm 558.

Figure 10:
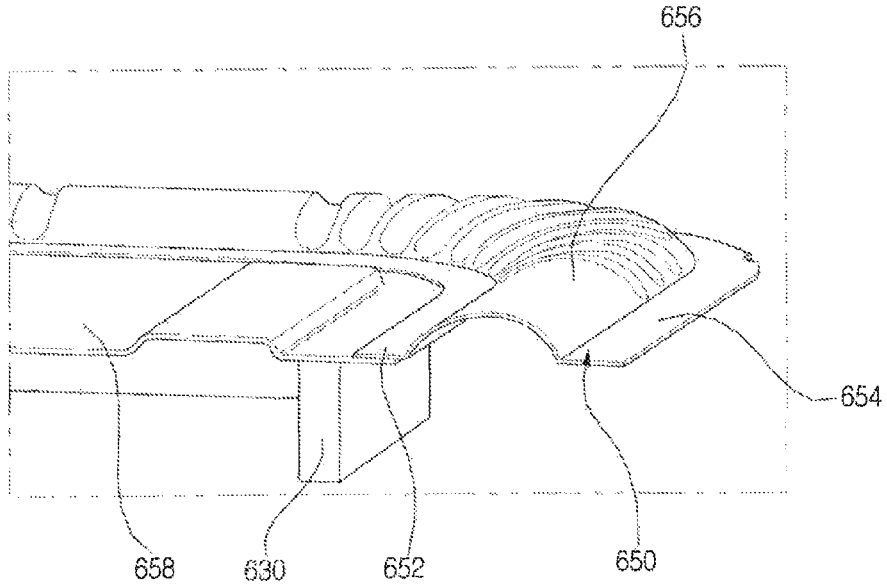
FIG. 10 is a view showing a bonding structure of a diaphragm for a microspeaker according to a seventh embodiment of the present invention.

FIG. 10 is a view showing a bonding structure of a diaphragm for a microspeaker according to a seventh embodiment of the present invention. The bonding structure comprises a side diaphragm 650 perforated in the center and including an inner peripheral portion 652, an outer peripheral portion 654, and a dome portion 656 projecting between the inner peripheral portion 652 and the outer peripheral portion 654, and a center diaphragm 658 attached to the inner peripheral portion 652 of the side diaphragm 650. The side diaphragm 650 and the center diaphragm 658 are attached by thermal compression. The side diaphragm 650 is attached to the top side of the center diaphragm 658, and a voice coil 630 is attached to the bottom side of the center diaphragm 658. However, the attachment position of the side diaphragm 650 and the attachment position of the voice coil 630 do not overlap each other but are spaced a predetermined distance apart from each other.

Figure 11:
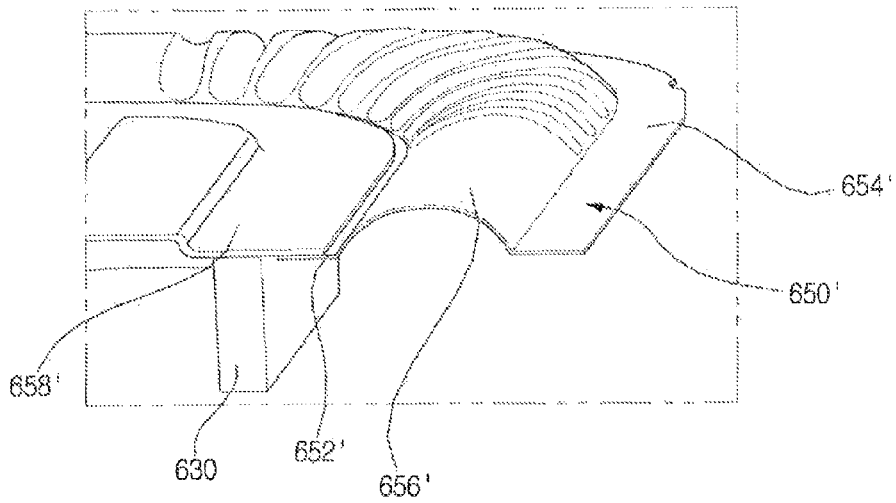
FIG. 11 is a view showing a bonding structure of a diaphragm for a microspeaker according to an eighth embodiment of the present invention.

FIG. 11 is a view showing a bonding structure of a diaphragm for a microspeaker according to an eighth embodiment of the present invention. The bonding structure comprises a side diaphragm 650' perforated in the center and including an inner peripheral portion 652', an outer peripheral portion 654', and a dome portion 656' projecting between the inner peripheral portion 652' and the outer peripheral portion 654', and a center diaphragm 658' attached to the inner peripheral portion 652' of the side diaphragm 650'. The side diaphragm 650 and the center diaphragm 658' are attached by thermal compression. Both the side diaphragm 650' and a voice coil 630 are attached to the bottom side of the center diaphragm 658'. The attachment position of the side diaphragm 650' and the attachment position of the voice coil 630 are spaced a predetermined distance apart from each other so as not to overlap each other.

Figure 12:
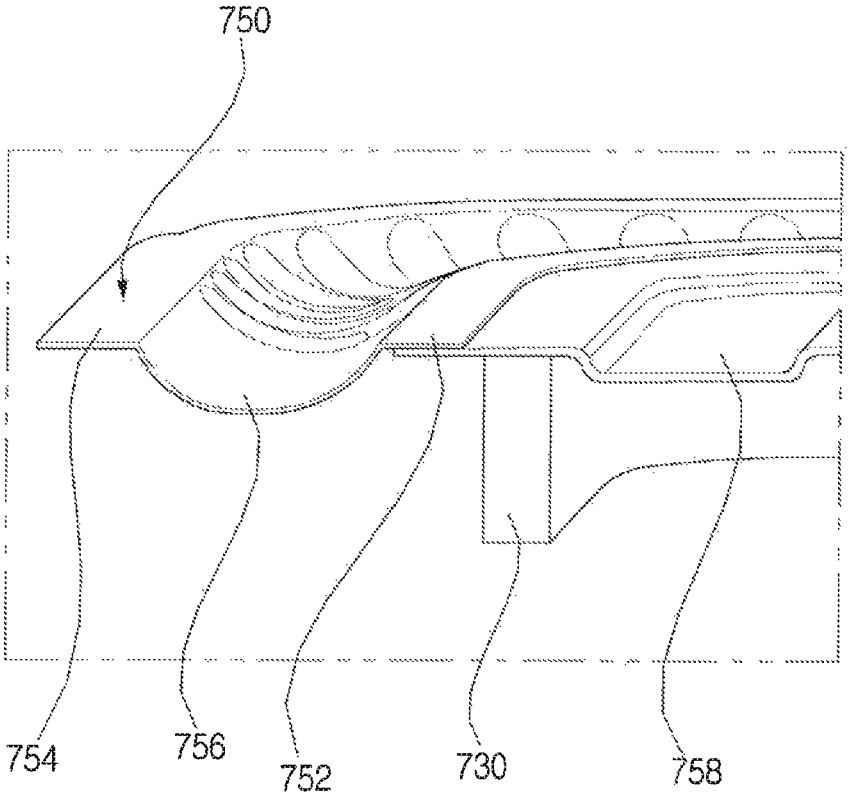
FIG. 12 is a view showing a bonding structure of a diaphragm for a microspeaker according to a ninth embodiment of the present invention.

FIG. 12 is a view showing a bonding structure of a diaphragm for a microspeaker according to a ninth embodiment of the present invention. The bonding structure comprises a side diaphragm 750 perforated in the center and including an inner peripheral portion 752, an outer peripheral portion 754, and a dome portion 756 projecting between the inner peripheral portion 752 and the outer peripheral portion 754, and a center diaphragm 758 attached to the inner peripheral portion 752 of the side diaphragm 750. The side diaphragm 750 and the center diaphragm 758 are attached by thermal compression. In this case, the dome portion 756 is in the shape of a reverse dome, which projects downward, unlike the seventh and eighth embodiments. The side diaphragm 750 may be attached to the top side of the center diaphragm 758, as shown in FIG. 12, and may also be attached to the bottom side of the center diaphragm 758. A voice coil 730 is attached to the bottom side of the center diaphragm 758. The voice coil 730 is spaced a predetermined distance apart from the inner peripheral portion 752 of the side diaphragm 750 so as not to overlap the inner peripheral portion 752 of the side diaphragm 750.

What is claimed is:

1. A bonding structure of a diaphragm for a microspeaker, the bonding structure comprising:

a suspension including a central portion, an outer peripheral portion, and a connecting portion connecting the central portion and the outer peripheral portion; and a side diaphragm including an inner peripheral portion and an outer peripheral portion, which are attached to the central portion and outer peripheral portion of the suspension, respectively, and a dome portion, which projects between the inner peripheral portion and the outer peripheral portion, wherein the suspension and the side diaphragm are attached by thermal compression.

2. The bonding structure as claimed in claim 1, wherein the suspension consists of an FPCB.

3. The bonding structure as claimed in claim 2, wherein the suspension comprises a base film, a conductive pattern attached to both sides of the base film, and a cover layer attached on the conductive pattern, and the cover layer attached to the side diaphragm is made of either a PEEK film or a PEI-F film.

4. The bonding structure as claimed in claim 1, wherein the side diaphragm is formed by joining two or more sheets of film together.

5. The bonding structure as claimed in claim 4, wherein the bonding surface of the side diaphragm is made of a TPU film, and the other surface of the side diaphragm is made of a PEEK film.

6. The bonding structure as claimed in claim 1, wherein the bonding surface of the side diaphragm is made of a TPU film, and the bonding surface of the suspension is made of either a PEEK film or a PEI-F film.

7. The bonding structure as claimed in claim 1, further comprising a bonding sheet interposed between the side diaphragm and the suspension, wherein the suspension and the side diaphragm are attached by being thermally compressed to the bonding sheet.

8. The bonding structure as claimed in claim 1, further comprising a center diaphragm attached to the central portion of the suspension, wherein the center diaphragm and the suspension are attached by thermal compression.

9. The bonding structure as claimed in claim 1, further comprising a center diaphragm attached to the side diaphragm, wherein the side diaphragm and the center diaphragm are attached by thermal compression.

10. The bonding structure as claimed in claim 9, wherein the voice coil is attached to the bottom side of the center diaphragm, spaced apart from the side diaphragm and the suspension.

* * * * *